US007891098B2

(12) United States Patent
Parker et al.

(10) Patent No.: US 7,891,098 B2
(45) Date of Patent: Feb. 22, 2011

(54) KNIFE WITH REPEATING ACTUATION

(75) Inventors: Harold Parker, Elma, WA (US); Hector Hernandez, Fullerton, CA (US)

(73) Assignee: Alltrade Tools LLC, Long Beach, CA (US)

( * ) Notice: Subject to any disclaimer, the term of this patent is extended or adjusted under 35 U.S.C. 154(b) by 370 days.

(21) Appl. No.: 12/101,916

(22) Filed: Apr. 11, 2008

(65) Prior Publication Data

US 2009/0255128 A1 Oct. 15, 2009

(51) Int. Cl.
*B26B 1/08* (2006.01)

(52) U.S. Cl. ..... 30/162; 30/335

(58) Field of Classification Search ..... 30/161, 30/335, 162

See application file for complete search history.

(56) References Cited

U.S. PATENT DOCUMENTS 2,552,945 A * 5/1951 Eaton et al. ..... 30/162
5,292,329 A * 3/1994 Werner ..... 606/167
5,426,855 A * 6/1995 Keklak et al. ..... 30/162
6,813,833 B2 * 11/2004 Saunders et al. ..... 30/162
7,316,070 B2 * 1/2008 Green ..... 30/162
7,322,110 B2 * 1/2008 Hernandez et al. ..... 30/162
2009/0255128 A1 * 10/2009 Parker et al. ..... 30/162
2009/0277016 A1 * 11/2009 Wu ..... 30/162
2010/0088900 A1 * 4/2010 Davis et al. ..... 30/162

* cited by examiner

*Primary Examiner*—Hwei-Siu C Payer
(74) *Attorney, Agent, or Firm*—Fulwider Patton LLP

(57) ABSTRACT

A knife is described that is capable of extending a blade from a front end of the blade, and subsequently retracting the blade into the body of the knife. Actuation of the blade from extended to retracted conditions is accomplished by way of an actuation element located external to the knife. A user may strike the knife backwards onto a work surface to extend the blade and, subsequently, to retract the blade. The same action by the user may be used to achieve the extended and the retracted blade condition.

13 Claims, 7 Drawing Sheets

KNIFE WITH REPEATING ACTUATION

BACKGROUND

The present application relates to knives, in particular to a knife that may extend a blade from, and subsequently retract the blade into, the body of the knife.

The use of knives by workmen is widespread, and many knives have been developed to improve upon the safe usage thereof. In particular, many solutions have been developed to the problem of safely storing the blade of a knife once it has been used.

Some knives allow the user to pivotably fold the blade into a compartment in the handle of the knife, so that the cutting edge of the blade is concealed and does not present a danger of accidental injury. A problem with such a folding knife is that it typically takes two hands to operate the blade opening and closing actions, particularly when it comes to opening the blade from a closed position.

Other knives have been developed that allow a blade to slide axially forward from a storage position within the knife to extend from the front end of the knife, and to subsequently axially retract back into the body of the knife when the blade has been used. These knives are typically operated by pressure sensitive elements on the handle of the knife manipulable by a thumb or forefinger. However, such knives typically may also require two different pressure sensitive elements, one for opening and one for closing the blade.

Some knives have been developed in which only one pressure sensitive element is provided for both opening and closing the blade. However, in such knives it is typical for example for a forward motion on the element to open the blade, and a backward motion on the element to close the blade. This has the disadvantage of introducing multiple hand actions for a user to apply. Moreover, such knives rely on complex internal mechanisms to achieve this effect.

Yet, circumstances frequently may require the maximum simplicity, namely a single consistent hand movement for both opening and closing operations because workmen are frequently obliged to work in confined circumstances where complex manual actions are difficult. Thus, there is a need in the art for a knife that is extremely simple to operate, simple and inexpensive to manufacture and assemble, that does not oblige the user to figure out what the appropriate hand movement is for the opening or closing action desired, and that can be operated with a great deal of simplicity. The present invention addresses these and other needs.

SUMMARY OF THE INVENTION

According to a preferred embodiment of the invention, there is described a knife that addresses some of the problems found in the prior art, providing ease of use by the user, and ease of manufacture leading to cost savings. In a preferred embodiment, the invention is a knife with a retractable blade comprising a housing defining an internal chamber, the housing having a front end from which the blade is extendable, and a rear end opposite the front end. A locking mechanism is provided within the housing chamber. The locking mechanism may include a blade holder for holding the blade, the blade holder being slidable within the housing from a forward position to a backward position, wherein the blade partially extends from the front end of the knife when the blade holder is in the forward position and the blade is withdrawn into the housing chamber when the blade holder is in the backward position. The locking mechanism further may include a biasing element configured to apply a constant bias on the blade holder toward the rear end of the housing. The locking mechanism also may include an actuation element for moving the blade holder backwards and forwards. The actuation element partially extends from the housing, the actuation element being linked to the blade holder. The locking element defines a regulation channel, the regulation channel having two opposing walls and a floor extending from one wall to the other wall, and the regulation channel defines a closed circuit. A snag element is attached to the housing, the snag element being configured to slide within the regulation channel with its movement confined by the two walls. The floor of the channel may include a plurality of steps that are configured to compel the snag element to move around the closed circuit in only one direction by allowing the snag element to move over each step in a downward direction, but not in an upward direction. The regulation channel also defines an open holding pocket and a closed holding pocket, the closed holding pocket being spaced forwardly from the open holding pocket, and each holding pocket being capable of capturing the snag element and preventing the snag element from immediately moving forward in relation to the blade holder (which has the result that the blade holder is prevented from moving immediately backward in relation to the housing) as the snag element slides within the channel, whereby the blade holder is held in equilibrium by the biasing means when the snag elements is located in either one of the open holding pocket or the closed holding pocket.

In a preferred embodiment, the regulation channel has four steps. Further preferred, the regulation channel is defined by the blade holder. Yet further preferred, the actuation element is configured in relation to the housing to slide linearly into the housing whereby forward movement of the actuation element is accompanied by forward movement of the blade holder, and rearward movement of the actuation element is accompanied by rearward movement of the blade holder. Preferably, the snag element is biased toward the floor of the channel.

In another aspect of the invention, a method of causing a knife blade to advance from a retracted position to extend the blade from a forward end of a knife, and subsequently to retract the blade into the knife is described. The method comprises the steps of providing a knife with a blade holder slidable within a housing of the knife, wherein movement of the blade holder to a forward position causes the blade to extend from the knife, and further wherein movement of the blade holder to a backward position causes the blade to withdraw into the housing. Further, providing an actuator element to partially extend from the knife, the actuator element being linked with the blade holder through a pinned linkage. When the user is ready to extend the blade, he depresses the actuator a first time into the housing, thereby advancing the blade from a retracted position to extend the blade from the forward end of the knife. When the user is ready to retract the blade into the knife, he depresses the actuator a second time into the housing, thereby retracting into the housing the extended blade.

Preferably, depressing the actuator may include striking the knife in a direction toward the back end of the knife to strike the actuator element on a working surface. Further preferably, advancing the blade from a retracted position to extend the blade from the forward end of the knife may include locking the blade holder in an equilibrium condition with the blade extending from the forward end of the knife. Locking the blade holder in an equilibrium condition with the blade extending from the forward end of the knife may include biasing the blade holder toward the rear end of the knife, and at the same time preventing the blade holder from moving toward the rear end of the knife with a snag element attached to the housing, which may include positioning the snag element in a channel defined by the blade holder.

Further preferably, retracting into the housing the extended blade may include locking the blade holder in an equilibrium condition with the blade retracted into the housing. In this case, locking the blade holder in an equilibrium condition with the blade retracted into the housing may include biasing the blade holder toward the rear end of the knife, and at the same time preventing the blade holder from moving toward the rear end of the knife with a snag element attached to the housing. Preventing the blade holder from moving toward the rear end of the knife with a snag element attached to the housing may include positioning the snag element in a channel defined by the blade holder.

These and other advantages of the invention will become more apparent from the following detailed description thereof and the accompanying exemplary drawings.

DETAILED DESCRIPTION OF THE PREFERRED EMBODIMENTS

Figure 2:
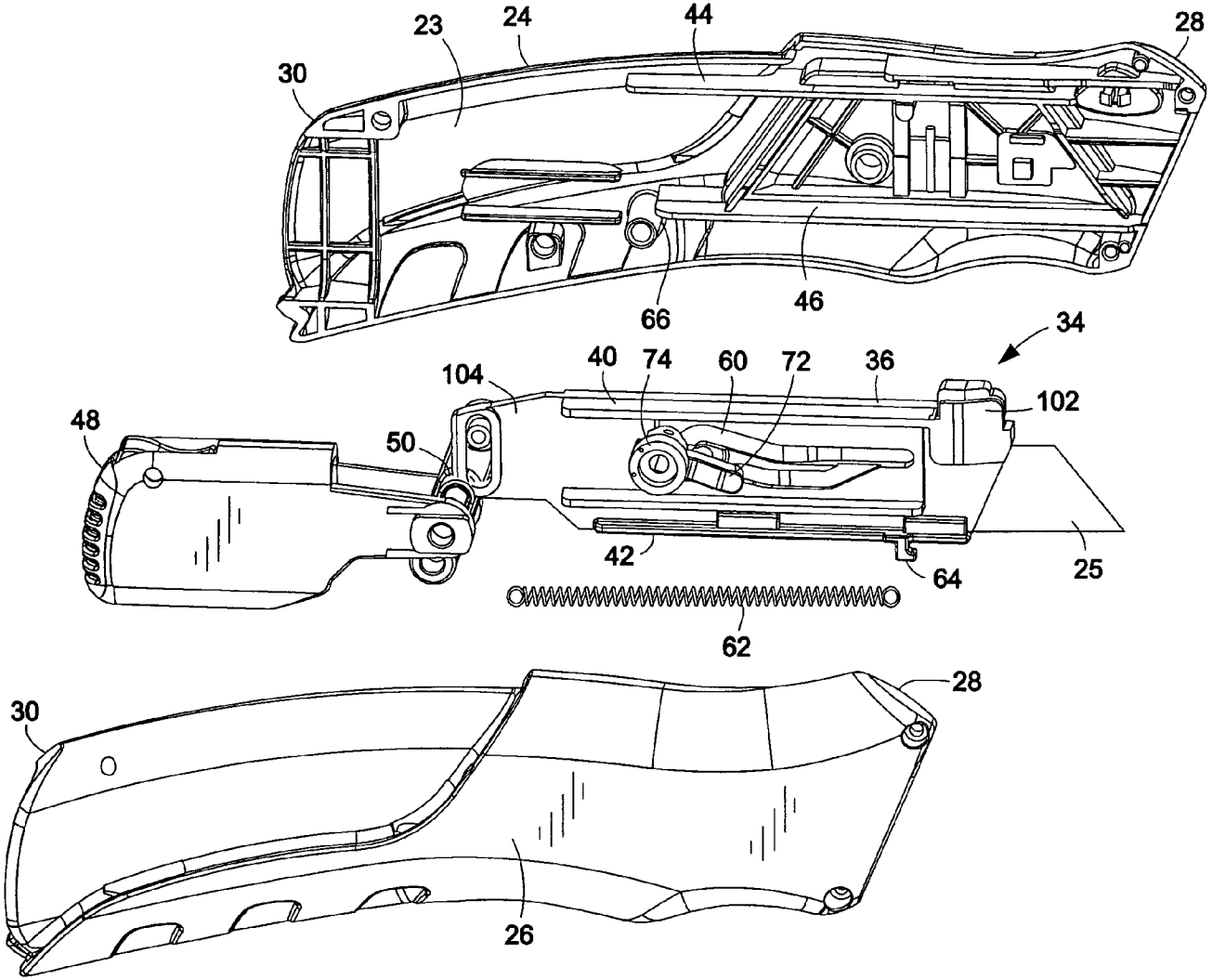
FIG. 2 is a perspective partially exploded view of some components of the knife of FIG. 1.

With reference to the figures, which are provided by way of exemplification and not limitation, there is disclosed a knife, generally identified by the numeral 20, and having features of the present invention. In a preferred embodiment, the knife comprises a housing 22 which is made up of two opposing halves 24 and 26. The housing defines a chamber 23 for enclosing the inner mechanisms of the knife. The knife has two ends, a front or forward end 28 from which a blade 25 may be extended, and a back end 30 opposite the forward end. The knife includes a locking mechanism 34 (FIGS. 2, 3, 6) configured to permit a user to extend the blade from the forward end 28, and to withdraw the blade into the housing chamber 23 for safety.

Figure 1:
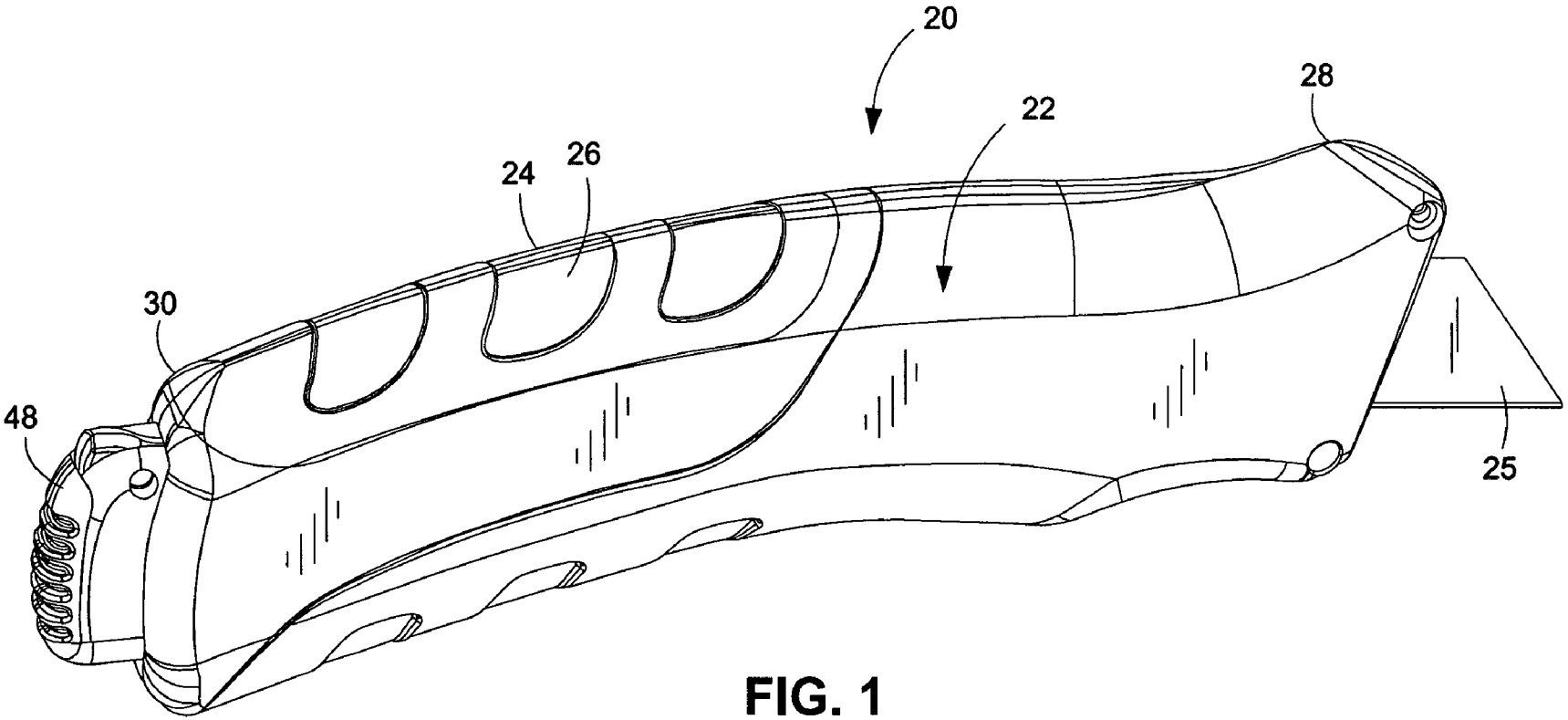
FIG. 1 is a perspective view of a knife having features of the present invention.
Figure 3:
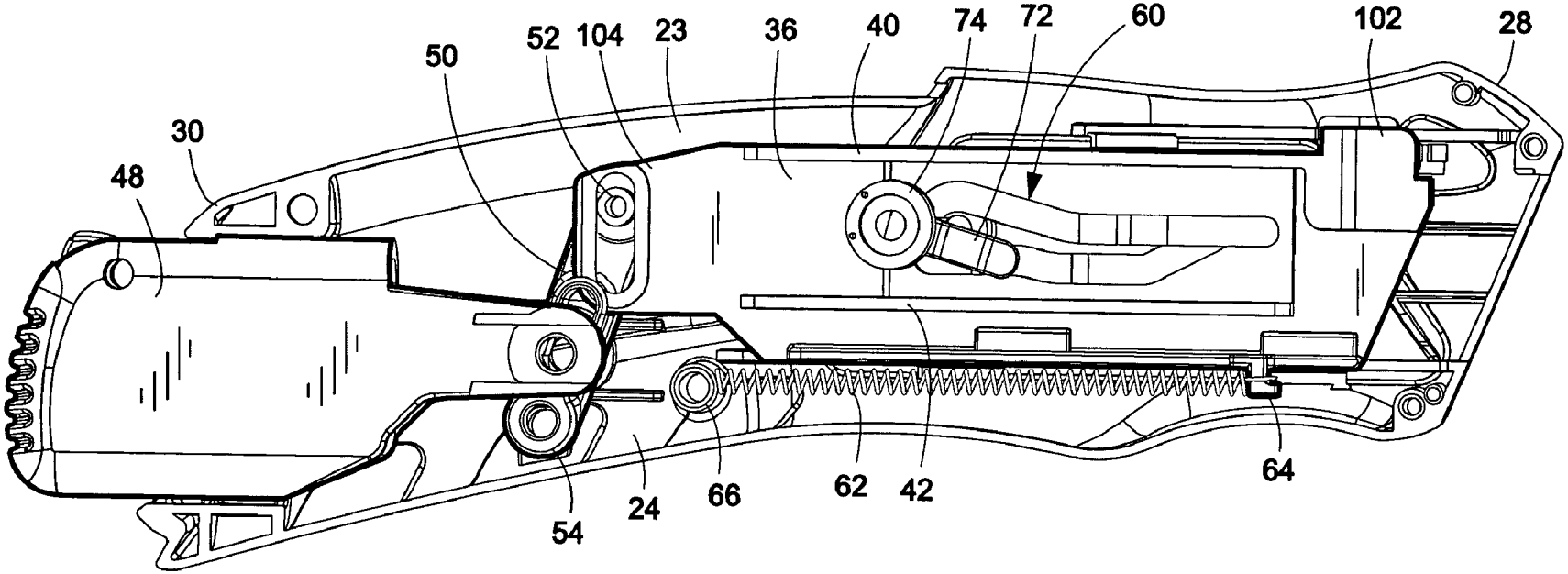
FIG. 3 is a perspective disassembled view of the knife of FIG. 1.

The locking mechanism 34 includes a blade holder 36 configured to support the blade 25 in any of a number of known ways. In a preferred embodiment, the blade may be removable from the blade holder 36 to be replaceable by a new blade, and the blade may have the trapezoidal profile of a standard utility knife blade. The blade holder is configured to slide within the housing between two positions, a first forward (or open) position in which the blade protrudes from the front end 28 of the housing for using the blade (FIG. 1), and a second backward (or closed) position in which the blade is withdrawn into the housing for holding the blade in safety. (The terms, forward, forwardly, are used herein as in a direction toward the front end 28 of the knife. The terms backward, backwardly, rearward, are used herein as in a direction toward the rear end 30 of the knife, unless another frame of reference is provided.) With reference to FIG. 3, the blade holder 36 may be seen positioned part way between the forward and backward positions. To facilitate the described sliding action, the blade holder 36 may have an upper planar surface 40 and a lower planar surface 42, both surfaces configured to match with upper and lower opposing surfaces 44, 46 on the housing for supporting the blade holder during sliding.

Figure 6:
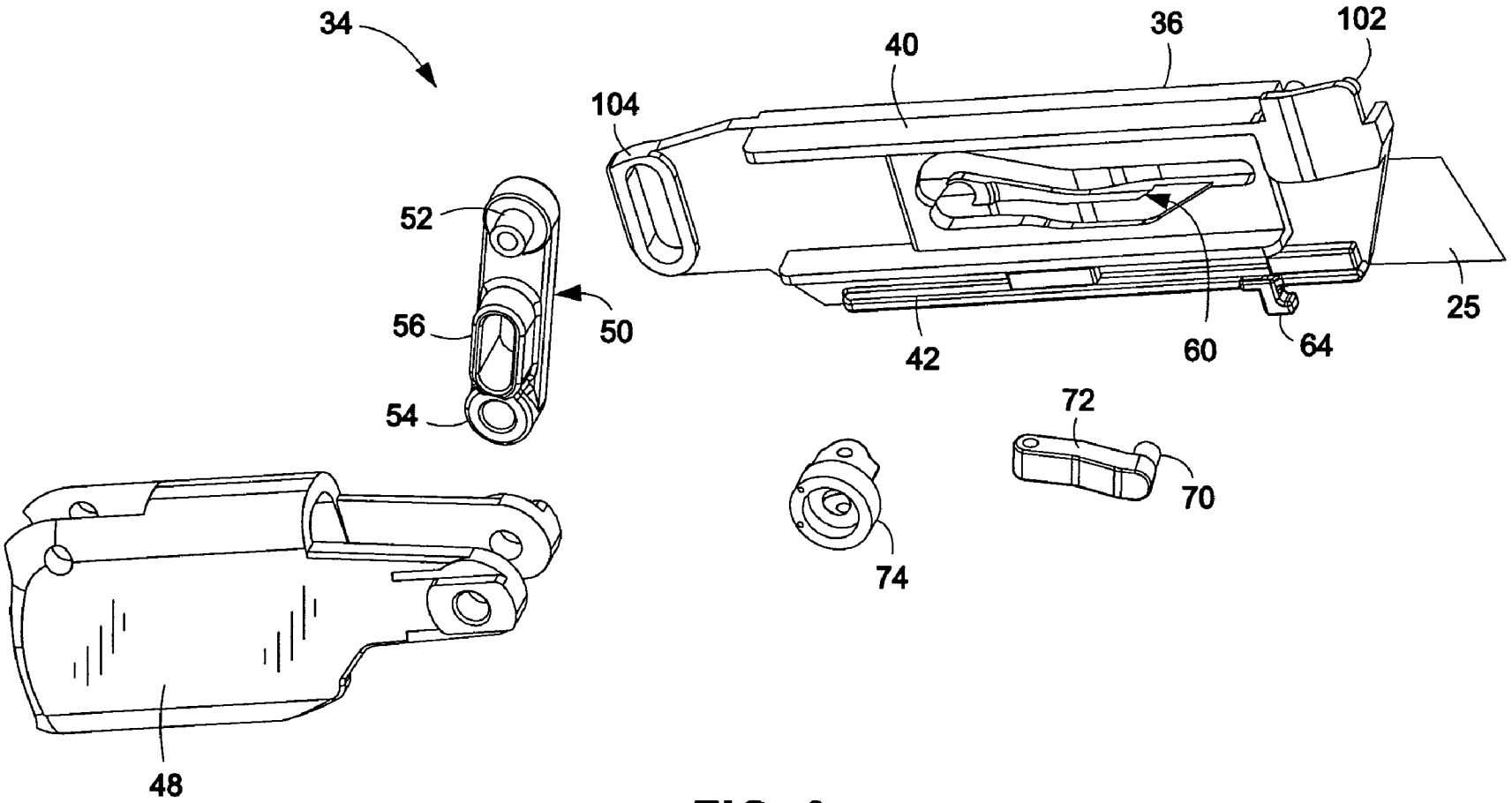
FIG. 6 is a perspective exploded view of locking components of the present invention.

The backward and forward sliding action of the blade holder is achieved by a user through displacing an external actuator 48 located, preferably but not necessarily, at the back end 30 of the knife. In a preferred embodiment, the external actuator extends from the back end 30 of the knife and may slide between a forward position that causes the blade holder 36 to advance to its forward position, and a backward position that causes the blade holder 36 to withdraw to its backward position. To assure directional conformity of movement between the actuator and the blade holder, a linking arm 50 (that is best seen in FIG. 6) may be provided that has a first end 52 and a second end 54. The arm is slidingly pinned at the first end 52 to the blade holder 36, and is pinned at the second end 54 to the housing 22. A middle portion 56 of the arm is slidingly pinned to the actuator 48, whereby any forward or backward movement of the actuator 48 must be followed in the same direction by the blade holder 36, preferably with a mechanical disadvantage in the region of about 1.1 to 3.5—so that any displacement of the actuator 48 is magnified in the movement of the blade holder 36 by the stated disadvantage range.

Figure 5:
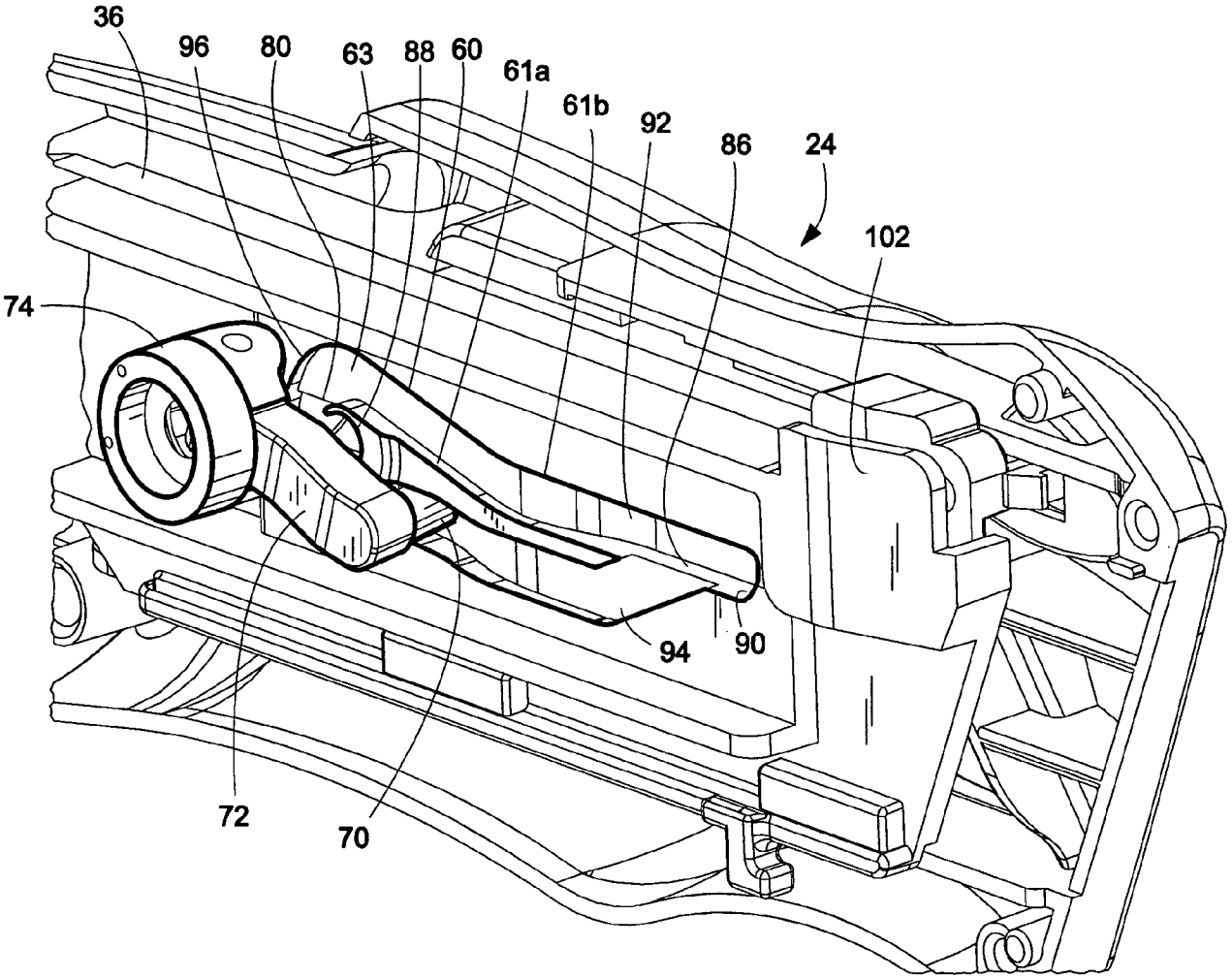
FIG. 5 is a view of an aspect of FIG. 4, with additional components having features of the present invention.

Thus, a full forward displacement of the actuator 48 by the user will cause the blade 25 to extend forwardly from the front end 28 of the knife, and a full backward displacement of the actuator by the user will cause the blade to withdraw into the safety of the knife's chamber 23. In order to regulate the sequential back and forth movement of the blade holder 36, a regulator channel 60 is provided in a lateral surface of the locking mechanism 34, preferably, in a lateral surface of the blade holder 36, although the channel could be provided in a surface of the actuation element 48. As seen in FIG. 5, the channel comprises two walls 61*a*, 61*b* that oppose each other, and a floor 63 that extends from one wall to the other. Preferably, the channel may be machined into the locking element component, or it may be cast during the formation of the component. The regulator channel 60 is especially shaped to compel the blade holder to pause in a "locked' position after each complete backward or complete forward displacement of the actuator 48, as explained in more detail below.

A further element for regulating the back and forth movement of the blade holder 36 is a return spring 62 (FIGS. 2 and 3) which may be attached at a forward end to a hook 64 on the blade holder 36 and at a rearward end to a cross bar 66 attached to the housing. The length of the return spring 62 is chosen so as to continuously bias the blade holder 36 toward the back end 30 of the knife, no matter where the blade holder is positioned within the housing.

Figure 7:
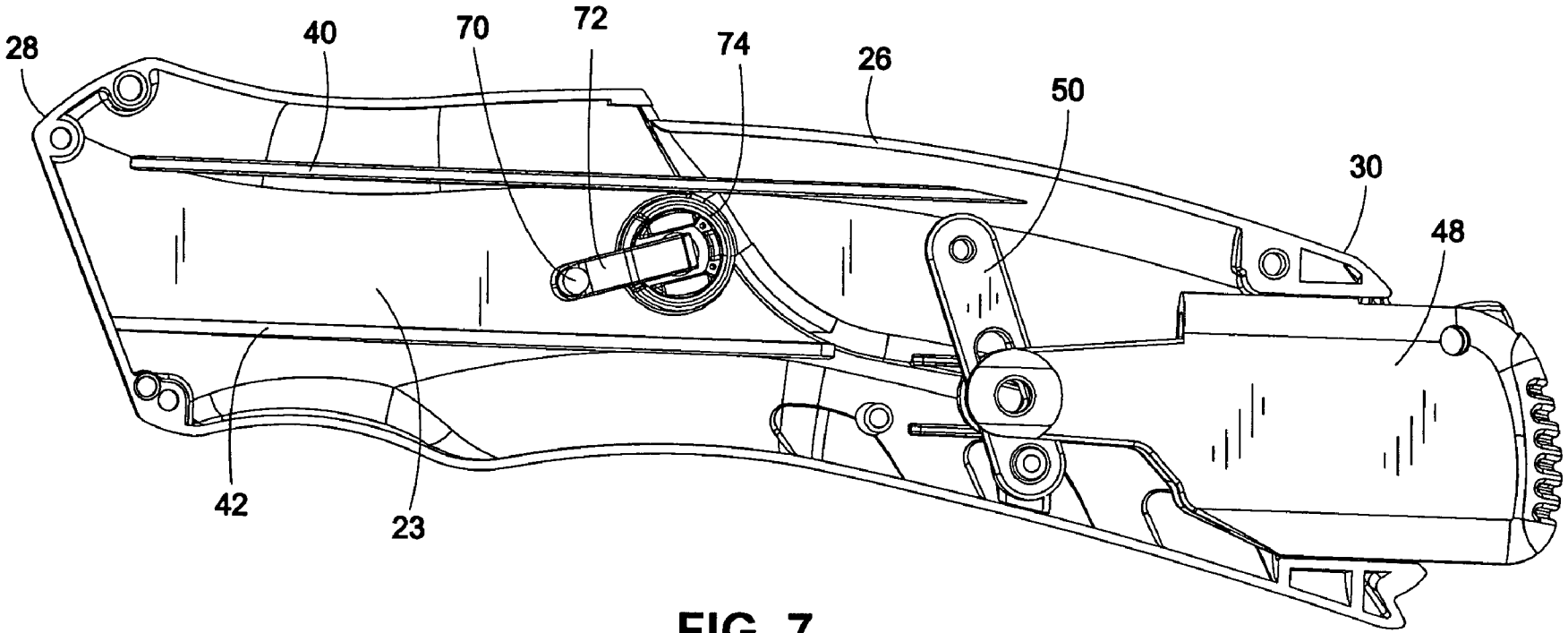
FIG. 7 is a perspective disassembled view of some components of the knife of FIG. 1

Yet a further element for regulating the back and forth movement of the blade holder is a snag element 70 (best seen in FIGS. 5, 6 and 7) which is preferably a cylindrically shaped element sized to slide within the regulation channel 60. The snag element 70 is continuously biased toward the floor 63 of the channel via a spring loaded arm 72 that is attached to a wall of the housing 22 (as best seen in FIG. 7). The arm 72 may be positioned on a hub 74 that is rotatably connected to one opposing half 26 of the housing 22, giving the arm 72 the capability of rotating sufficiently on the hub to allow the snag element 70 to move vertically up and down to some degree, in order to allow the snag element to remain confined between the walls 61*a*, 61*b* of the channel 60 as the blade holder 36, and hence the channel 70, is moved backwards and forwards past the snag element 70 during operation of the locking element 34.

Figure 4:
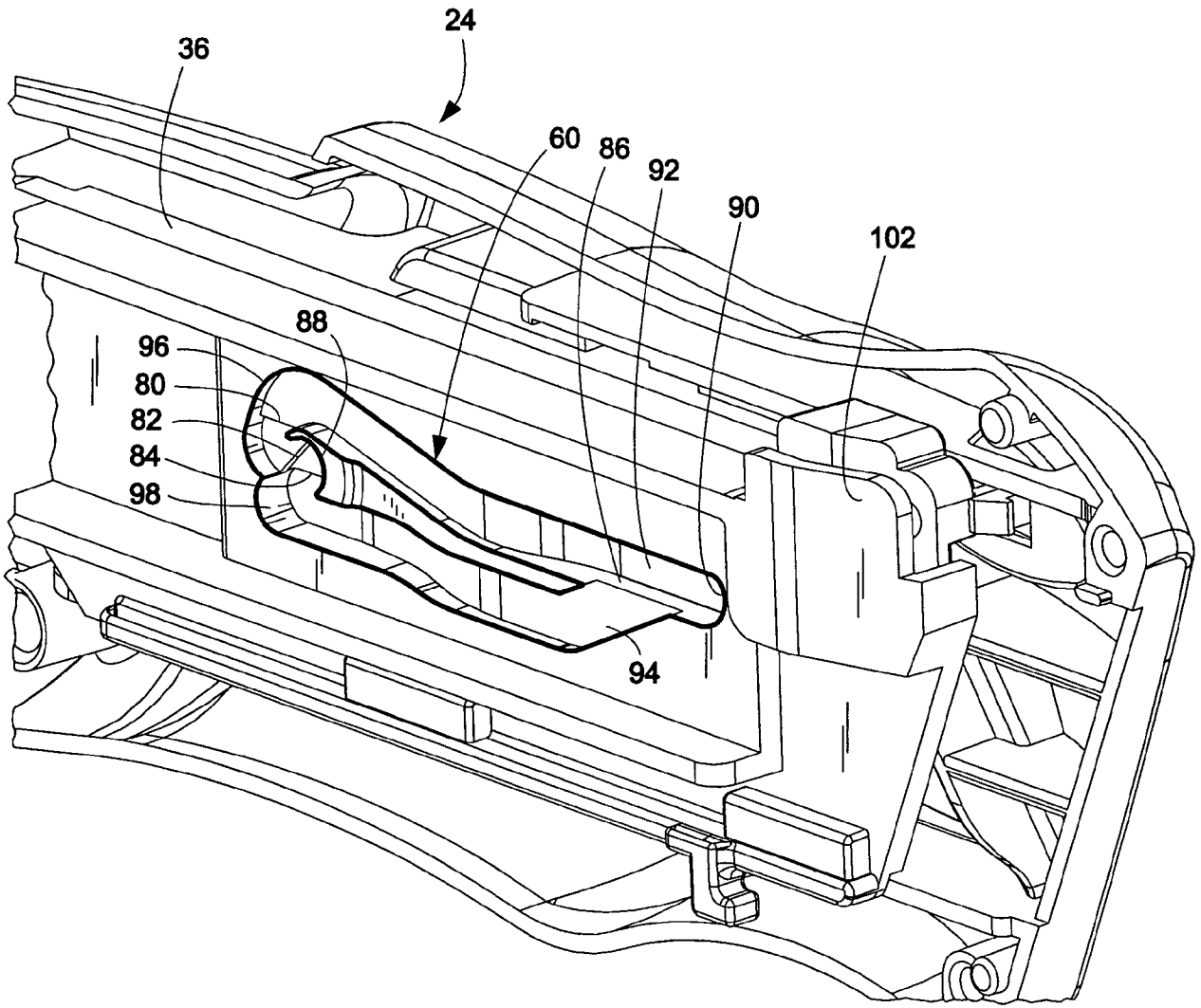
FIG. 4 is a detailed perspective view of internal features of the knife of FIG. 1.

Turning to the preferred shape of the regulation channel, the regulation channel 60 preferably has the following characteristics to achieve its regulation function. These characteristics are best seen with reference to FIGS. 4 and 5. First, the channel 60 includes a continuous closed circuit, allowing the snag element 70 to travel continuously and repeatedly around the length of the circuit under displacement of the actuator 48 by the user. It will be appreciated that the walls 61*a*, 61*b* of the channel confine the snag element 70 between the walls, and compel the snag element to move only within the confines of the channel. This configuration has the result, as described in more detail below, that movement of the blade holder 36 in the housing 22 may be prevented due to the mechanical interaction between the snag element and the walls of the channel. Second, the floor 63 of the channel has a plurality of steps 80, 82, 84, 86 that are always "downward" from the perspective of the snag element 70 moving along the channel 60. Indeed, these steps compel the snag element to move only in one direction around the circuit, and prevent the snag element from reversing its direction of motion at critical points along the circuit of the channel. Third, the channel has two "holding pockets" along its length, namely an open holding pocket 88 and a closed holding pocket 90. Each holding pocket is characterized by a section of the channel that has a wall characterized in that, once the snag element is caught in a holding pocket, the snag element cannot escape while the blade holder is under the force only of the return spring 62. Only the intervention of the user can cause the snag element to escape from a holding pocket 88, 90 and continue its motion around the circuit, thereby allowing the blade holder 36 to move relative to the housing 22. Stated another way, once the snag element 70 is located within either of the holding pockets 88, 90, the snag element cannot immediately move (relative to the blade holder) toward the front end 102 of the blade holder 36. Rather, it can only immediately move toward the back end 104. This has the result that, under the bias of the spring 62, and without the intervention of the user, the blade holder 36 is locked into an equilibrium position in either the forward or the backward position when the snag holder is captured in a holding pocket. Thus, the blade holder cannot immediately move toward the rear end 30 of the housing when the snag element 70 is in a holding pocket. In such an equilibrium position, the blade holder 36 is motionless, pulled backwards by the spring 62, but prevented from moving backwards by a holding pocket 88 or 90 interacting with the snag element 70. Only the intervention of a user can remove the blade holder from an equilibrium position. Thus the snag element 70 "utilizes" the holding pockets 88, 90 to hold the blade holder 36 in equilibrium against the bias of the spring 62 without movement of the blade holder 36, in either the forward or the backward direction, until the user depresses the actuator 48 to exchange one equilibrium position for another, i.e. the forward equilibrium for the backward equilibrium position, or the backward for the forward.

In use, a preferred operation of the knife 20 of the present invention is as follows. Assuming the blade holder 36 starts in the closed or backward position with the blade retracted, the snag element 70 will be positioned in the closed holding pocket 90 which is positioned toward the forward end of the channel 60. When the blade holder 36 is in this position, the restoring spring 62 will be lengthened to some extent, and will thus exert a retraction force on the blade holder to prevent the blade holder 36 from moving forward under its own weight. Of course, the blade holder is prevented from moving immediately backward by the snag element 70 positioned in the closed holding pocket 90. The user then applies a displacement to the external actuator 48 to force it toward the front end 28 of the knife, in which case the arm 50 will apply a slightly magnified displacement to the blade holder 36, forcing the blade holder forward also so that the snag element 70 is compelled to slide backwardly (i.e., backwardly relative to the blade holder, because the snag element is essentially motionless in the backward and forward direction relative to the housing) down a top lane 92 of the channel 60. When the snag element 70 reaches a back end 96 of the top lane, the channel curves downwardly to some extent, and passage of the snag element between the walls 61*a* and 61*b* of the channel 60 tips the snag element over the first downward step 80. It will be appreciated that because the snag element is biased toward the floor 63 of the channel, the snag element cannot travel in the reverse direction (relative to the blade holder 36) back over the first step 80. Thus, the user, feeling that he can forwardly displace the actuator 48 no further, removes any manual load from the actuator. The retraction spring 62 then pulls the blade holder 36 backwards a small amount to force the snag element forwardly (relative to the blade holder 36) in the channel 60, until the snag element is caught in the open holding pocket 88 from where it cannot escape absent intervention by the user because of the curvature of the channel wall at the point of the holding pocket 88. In moving forward around the channel circuit by the described small amount, the snag element will have also fallen over a second downward step 82 that prevents the snag element from reversing its travel along the direction it had come. When the snag element 70 is positioned within the open holding pocket 88, the blade holder is in an open or forward equilibrium position, as has been described. Accordingly, when the user decides to restore the blade holder to its closed position, he applies a forward force once again upon the actuator 48 in the same way as before. This force will cause the snag element 70 to move backward (relative to the blade holder 36) a short distance and fall over a third downward step 84, until the snag element can move backward no more (relative to the blade holder) because it is prevented by a backstop corner 98, whereupon the user, sensing resistance to further forward movement of the actuator 48, removes manual force from the actuator. Upon such removal, the retraction spring 62 pulls the blade holder 36 backwards, causing the snag element 70 to travel forwards (relative to the blade holder) up a bottom lane 94 of the channel until the snag element reaches the fourth downward step 86, at which point the snag element falls into the top lane 92 of the channel, and then moves (relative to the blade holder 36) further forwardly along the top lane 92 to the end where it is arrested by the closed holding pocket 90. It will be appreciated that at this point, the blade holder 36 is in equilibrium in its closed or backward equilibrium position once again; it cannot move forwardly in the housing because it is restrained by the retraction spring 62, and it cannot move further backwards because it is prevented by the snag element 70, which is operatively fixed to the housing and captured in the closed holding pocket 90. Under these conditions, in addition to being restrained by the retraction spring against forward movement, the blade holder 36 can additionally, if desired, be mechanically blocked from further forward movement by an structural element that may be fixed to the housing.

Thus, the snag element 70 has, relatively speaking, made a full cycle around the channel 60. At the same time, the blade holder 36 has started at the closed equilibrium position, passed to the open equilibrium position, and ended at the closed equilibrium position. When in this closed position, the user may decide to advance the blade to the open position, as before, by depressing the actuator 48 in a forwardly direction into the housing 22. It will be appreciated that, when the user displaces the actuator 48 forwardly once more from this closed position (in which the snag element 70 is in the closed holding pocket 90), the snag element travels backward (relative to the blade holder) down the upper lane 92 of the channel, and will not be able to enter the bottom lane 94 at the fourth step 86 because it is an upward step, and the snag element is biased toward the floor 63 of the channel. Thus, repeated displacement of the actuator forwardly will repeatedly exchange the equilibrium position of the blade holder 36 between the open and the closed equilibrium positions.

Thus, it has been described how the blade holder 36 moves from its closed equilibrium position, to its open equilibrium position, and back to its closed position again, during which movement the snag element 70 makes a complete circuit (relative to the blade holder) around the regulation channel 60 and is prevented by a plurality of downward steps 80, 82, 84, 86 from reversing the direction of travel along the channel at the location of those steps. It will be appreciated that a similar result could be achieved with a different number of steps, but in the preferred embodiment, four steps advantageously suit the configuration of the channel described.

Accordingly, it is seen from the above description that the user action required to move the blade holder from its backward to its forward equilibrium position is the same as the user action required to move the blade holder from its forward to its backward equilibrium position. In a preferred method of use, in each case the user may move the knife rearwardly to strike a fixed work surface (not shown) with the external actuator 48, thus forcing the external actuator forwardly into the housing 22 of the knife. The user then removes the knife from contact with the fixed surface to allow the retraction spring 62 to move the blade holder into a position where further movement of the blade holder is prevented by the snag element 70 engaged in either the open holding pocket 88 or the closed holding pocket 90 of the channel 60 on the blade holder 36. In an alternative preferred method of use, the user may grasp the knife with the hand and place the thumb, or other finger, on the actuator 48. By repeatedly depressing the finger to depress the actuator 48 into the housing, the user may exchange the open for the closed equilibrium position, and vice versa. This has the advantage of allowing the user to open and close the knife blade with a minimum of hand movement in which each hand movement is the same for both opening and closing. This is highly desirable when the user is working in a confined space and does not have both hands free.

Thus, it is seen that the knife of the present invention provides novel and useful features, and overcomes shortcomings in the prior art. The present invention may, of course, be carried out in other specific ways than those herein set forth without departing from the essential characteristics of the invention. The present embodiments are, therefore, to be considered in all respects as illustrative and not restrictive, and all changes coming within the meaning and equivalency range of the appended claims are intended to be embraced therein.

We claim:

1. A knife with a retractable blade, the knife having a housing defining an internal chamber, and having a front end from which the blade is extendable and a rear end opposite the front end, and a locking mechanism movable within the chamber, the locking mechanism comprising:

a blade holder for holding the blade, the blade holder being slidable within the housing from a forward position in which the blade partially extends from the front end of the knife, to a backward position in which the blade is withdrawn into the chamber;

a biasing element configured to bias the blade holder toward the rear end of the knife;

an actuation element for moving the blade holder backwards and forwards, the actuation element partially extending from the housing for manual control, the actuation element being operatively linked to the blade holder;

a regulation channel having two opposing walls, and a floor extending from one wall to the other wall, the regulation channel defining a closed circuit;

a snag element operatively attached to the housing, the snag element being configured to slide within the regulation channel as the locking mechanism moves within the housing;

wherein, the floor of the channel includes a plurality of steps that are configured to compel the snag element to move around the closed circuit in only one direction by allowing the snag element to move over each step in a downward direction, but preventing it from moving in an upward direction;

and further wherein, the regulation channel walls define an open holding pocket and a closed holding pocket, the closed holding pocket being spaced forwardly from the open holding pocket, and each holding pocket being configured such that, when the snag element is located in a holding pocket, the snag element cannot move immediately forward in relation to the locking mechanism as the snag element slides within the channel, whereby the locking mechanism is held in equilibrium by the biasing element.

2. The knife of claim 1, wherein the regulation channel has four steps in number.

3. The knife of claim 1, wherein the regulation channel is defined by the blade holder.

4. The knife of claim 1, wherein the actuation element is configured in relation to the housing to slide linearly into the housing.

5. The knife of claim 4, wherein the actuation element is configured in relation to the housing to slide into the rear end of the housing.

6. The knife of claim 1, wherein the actuation element is linked to the blade holder so that forward movement of the actuation element causes forward movement of the blade holder, and rearward movement of the actuation element causes rearward movement of the blade holder.

7. The knife of claim 1, wherein the snag element is biased toward the floor of the channel.

8. The knife of claim 7, wherein the snag element is positioned on an elongate arm and perpendicular to the arm, the arm being rotatably attached to the housing.

9. The knife of claim 1, wherein the snag element includes a cylindrical portion.

10. The knife of claim 1, wherein the actuation element is operatively linked to the blade holder through a linking element, the linking element being pinned to the housing.

11. The knife of claim 10, wherein the linking element is slidably pinned to the blade holder.

12. The knife of claim 10, wherein the linking element is slidably pinned to the actuation element.

13. The knife of claim 10, wherein movement of the actuation element causes movement of the blade holder with a mechanical disadvantage, whereby movement of the blade holder is greater than movement of the actuation element.

* * * * *